US005720512A

United States Patent [19]

Hostetler

[11] Patent Number: 5,720,512

[45] Date of Patent: Feb. 24, 1998

[54] PICNIC TABLE ASSEMBLY

[75] Inventor: Vernon Hostetler, Hartville, Ohio

[73] Assignee: Stark Forest Products, Inc., Canton, Ohio

[21] Appl. No.: 743,910

[22] Filed: Nov. 4, 1996

[51] Int. Cl.[6] ..... A47B 83/02

[52] U.S. Cl. ..... 297/158.5; 297/157.1; 297/158.3; D6/337

[58] Field of Search ..... 297/157.1, 158.3, 297/158.5; D6/337

[56] References Cited

U.S. PATENT DOCUMENTS

| | | | |
|---|---|---|---|
| D. 165,710 | 1/1952 | Currie et al. | 297/158.3 X |
| D. 173,910 | 1/1955 | Neuendorf | 297/158.3 X |
| D. 196,121 | 8/1963 | Soszynski | D6/337 |
| D. 211,796 | 7/1968 | Conklin | D6/337 |
| D. 266,211 | 9/1982 | Thom et al. | D6/337 |
| D. 279,433 | 7/1985 | Fuchs | D6/337 |
| D. 310,451 | 9/1990 | Webb | D6/337 |
| D. 315,254 | 3/1991 | Walters | D6/337 |
| 2,713,889 | 7/1955 | White | 297/158.3 |
| 3,120,405 | 2/1964 | Soszynski | 297/158.3 |
| 4,917,436 | 4/1990 | Thom | 297/157.1 |

*Primary Examiner*—Peter M. Cuomo
*Assistant Examiner*—Rodney B. White
*Attorney, Agent, or Firm*—Paul Bogdon

[57] ABSTRACT

A picnic table including a flat table section and four equally arcuately spaced support assemblies. Each support assembly has interconnected detachable elements. There is a lower seat base shaped for engaging a generally horizontal surface. Upwardly extending seat leg members are secured to each end of the seat base. A secondary leg member is fixed at its lower end to the inside of the seat base and its upper end fixed to the underside of the table. A pair of parallel wing members is arranged above its seat base, one each being fixed to the secondary leg. An angle brace is fixed between the inner section of the wing member and has its upper end fixed to the underside of the table. A top brace is fixed at one end to the wing member with the other end fixed to wing member of an adjacent support assembly. A flat seat assembly is fixed to the upper outer section of the wing members and to the upper ends of seat legs. The table section and the elements of the support assemblies are shaped and sized such that when the elements are disassembled they may be arranged in a crossed pattern on the underside of the table in a sandwiched arrangement for packaging and shipping.

10 Claims, 6 Drawing Sheets

PICNIC TABLE ASSEMBLY

BACKGROUND OF THE INVENTION

This invention relates to a picnic table assembly including detachable elements forming table support sections which elements may be arranged with the table section of the assembly to form a flat, compact arrangement for packaging and shipping.

Outdoor picnic tables of various configurations and sizes are well known. They are generally constructed of wood. The producer of the picnic tables may have them shipped assembled or with the elements disassembled. In either case the packed items are bulky, taking considerable room on any shipping vehicle. The number of tables shipped is limited because of the bulkiness. Additionally, arranging the table units in a shipping compartment is time consuming results in high labor costs. Shipping cost per table unit is therefore unnecessarily high. There is no known arrangement of assembled or disassembled picnic tables which overcome the space absorbing bulkiness in shipping and transporting.

This invention overcomes the heretofore limitations and problems inherent in transporting picnic tables and such like assemblies by providing an assembly constructed of detachable elements sized and shaped such that they may be arranged in a compact pattern for packaging and shipping. The element of the table of my invention when assembled provide an assembly which is sturdy as well as being attractive. For purposes of shipping the tables the elements are detached and placed in the underside of the table in a crossed pattern to define a generally flat layered sandwiched pattern. The entire arrangement is packaged and several such packages may be stacked and bound onto a shipping pallet. Pallets of packaged tables may then be emplaced in a shipping compartment with a minimum of unused space realized. The pallets would be loaded using a fork lift and would be done quickly and efficiently.

SUMMARY OF THE INVENTION

This invention provides a picnic table and the like which preferably comprises: a generally flat table member; a plurality, preferably four of, identical, arcuately, spaced support assemblies secured to the underside of the table, each of the support assemblies having detachable elements including: (a) a lower transverse seat base shaped for engaging a horizontal surface such as floor or the ground; (b) a pair of identically shaped upwardly extending seat legs, one each secured at its lower end to an end portion of the seat base; (c) an upwardly extending secondary leg fixed at its lower end to the inside of an intermediate section of the seat base and having its upper end fixed to the underside of the table; (d) a pair of parallel wing members arranged above the seat base fixed to and surrounding a mid-section of the secondary leg; (e) an upwardly extending angle brace fixed to and between the inner sections of the wings and having its upper end fixed to the underside of the table; and (f) a seat assembly fixed to the upper outer section of the wings and to the upper ends of the seat legs. The table and the elements of each support assemblies are sized and shaped such that when disassembled the elements may be arranged in a crossed pattern on the underside of the table to define a generally flat layered sandwiched pattern for packaging and shipping. A top brace may also be included with one of its ends fixed to an inner section of a wing with the other end of the top brace fixed to an inner end of an adjacent wing. Where the picnic table has four equally arcuately spaced support assemblies the collective top braces would from a generally square outline. The table is preferably circular in general outline which would include an octagonal or hexagonal shape. The seat assembly would be preferably V-shaped following the outline of the table.

Various other details, advantages, and modifications of the present invention will become apparent as the following description of a certain present preferred embodiment proceeds.

DESCRIPTION OF THE DRAWINGS

In the accompanying drawings I show a certain present preferred embodiment of my invention in which.

DESCRIPTION OF A PREFERRED EMBODIMENT

Figure 6:
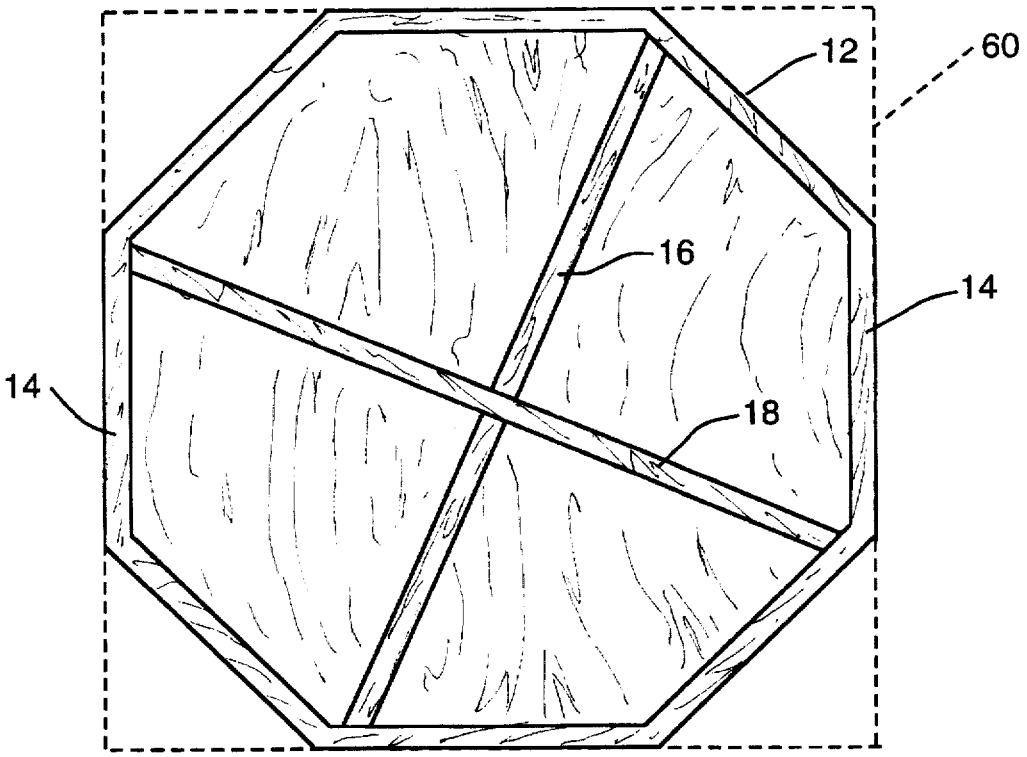
FIGS. 6–10 are plan views of schematic representations of the elements forming the picnic table assembly of this invention showing sequential layering of the elements on the underside of the table to form a generally sandwiched pattern or arrangement.
Figure 7:
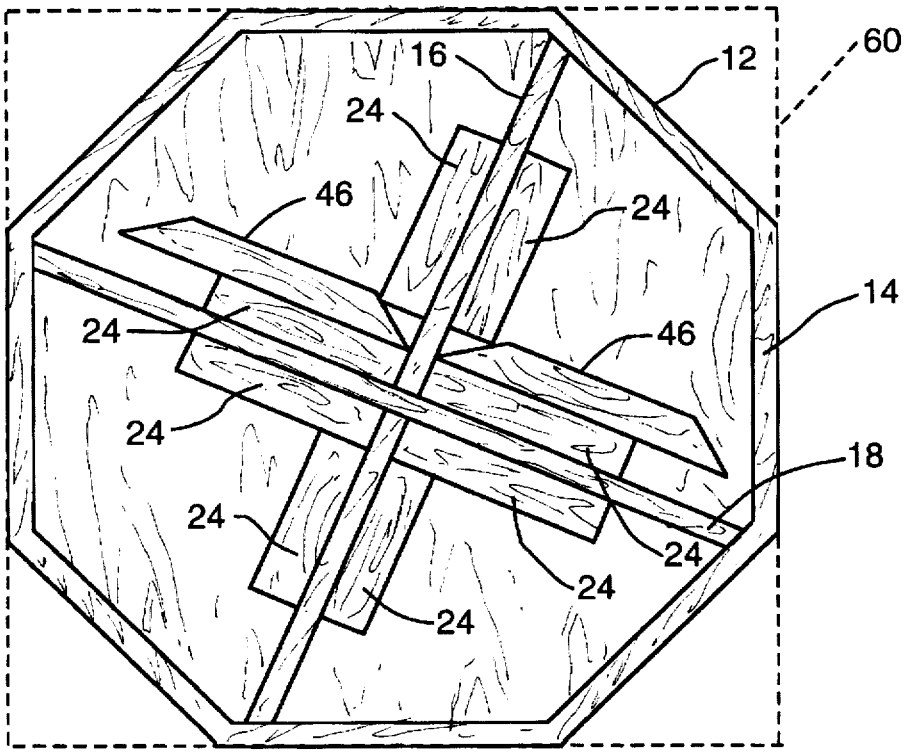

Referring now to the drawings there is shown a picnic table assembly 10 embodying the present invention. Reference throughout is made to a picnic table. This invention is not limited to a picnic table but contemplates any utility table. The picnic table assembly 10 includes a generally flat table 12 formed in an octagonal shape from suitably shaped wood sections, nine shown. The table 12 includes a vertically extending fringe 14 fixed to the underside of the table top. As shown in FIG. 6 the top of the table 12 is reinforced with cross braces 16 and 18 fixed to the hinge 14 and underside of the table.

Figure 1:
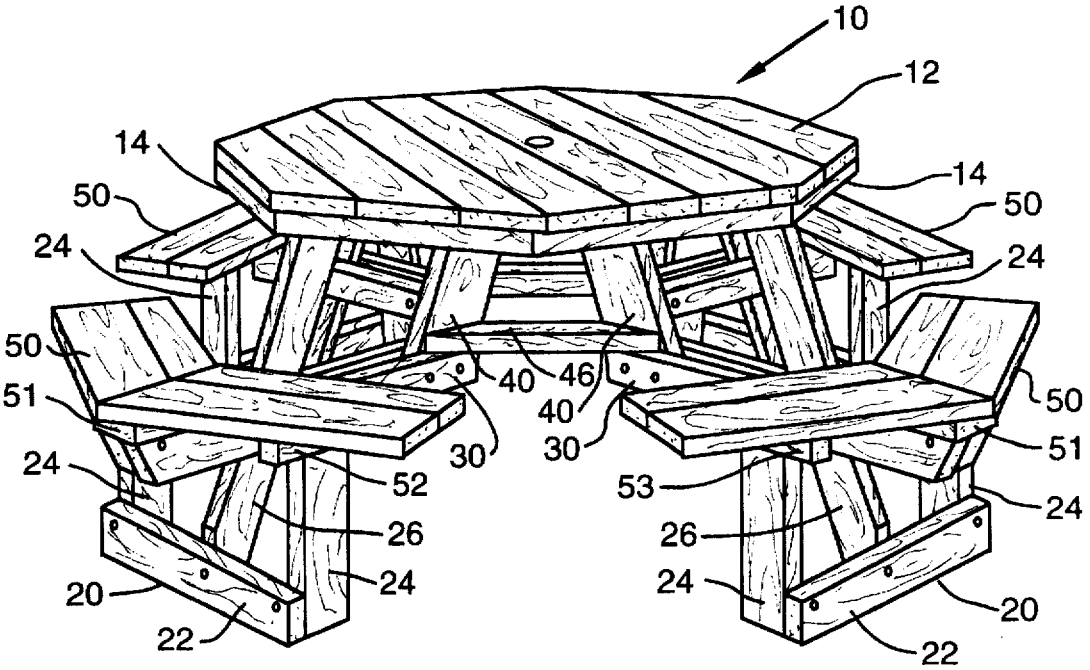
FIG. 1 is a perspective view of a picnic table assembly embodying this invention.
Figure 2:
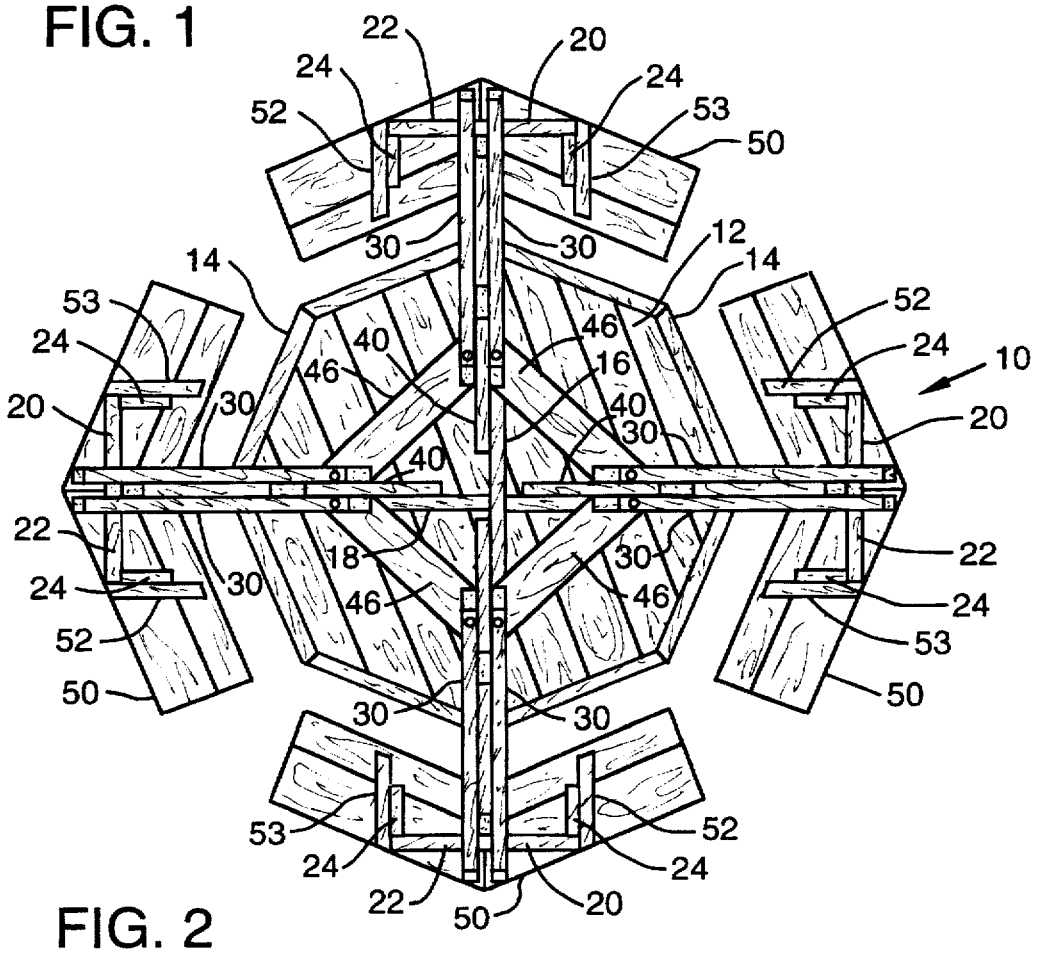
FIG. 2 is bottom plan view of the table section of the assembly of FIG. 1 showing details of construction of the underside of the table section.
Figure 3:
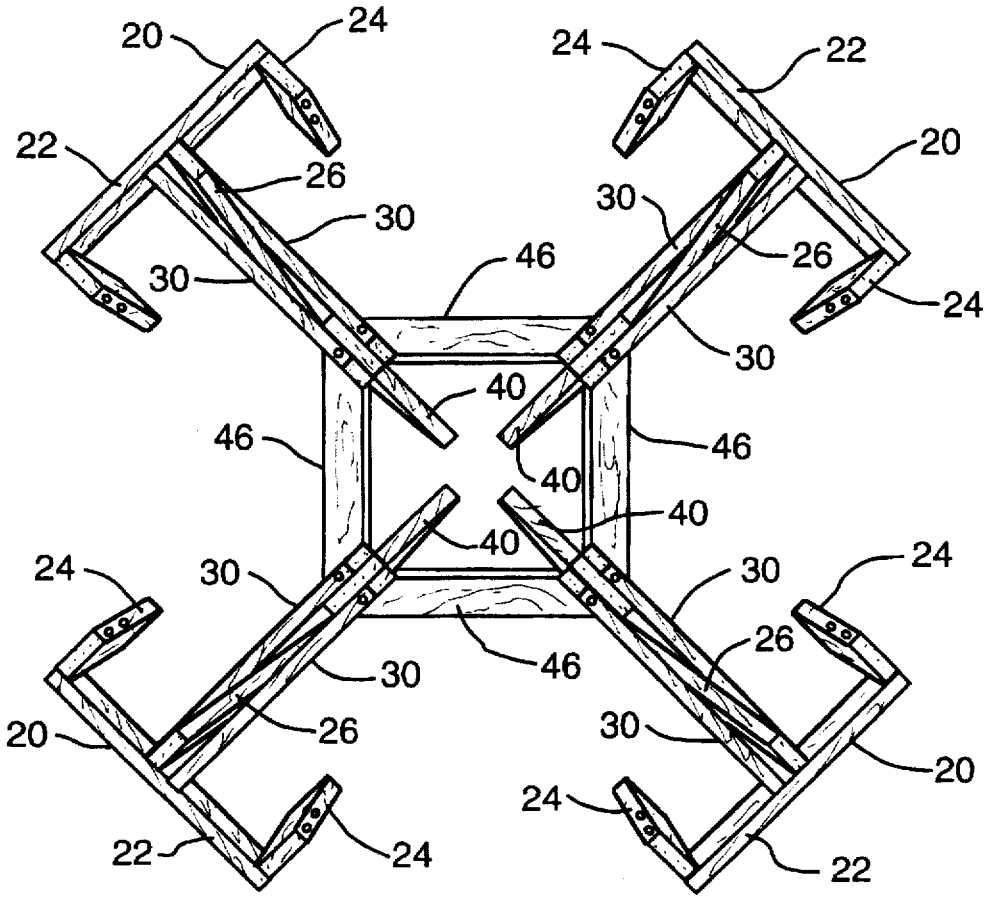
FIG. 3 is a perspective view of the assembled support units without the table section and looking from the bottom showing details of construction of the support units.
Figure 4:
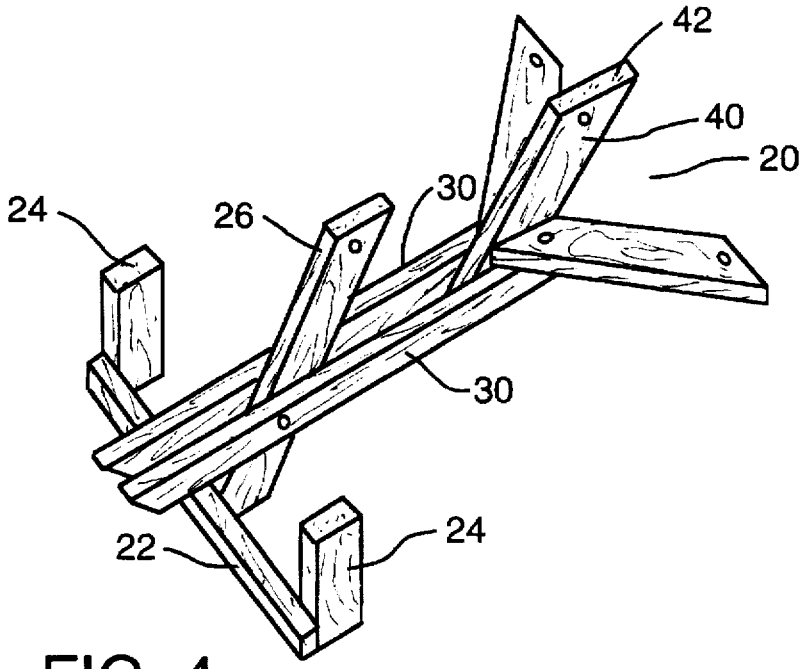
FIG. 4 is a perspective view of one of the support units looking from the top thereof.
Figure 5A:
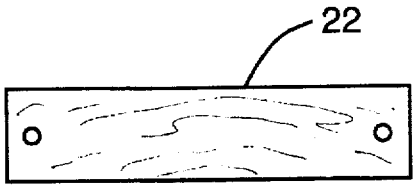
FIGS. 5*a*–5*f* are is a collective elevation view of all of the elements forming a single support unit showing the angular form of the ends of the same elements.
Figure 5B:
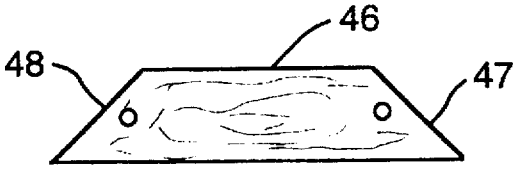
Figure 5C:
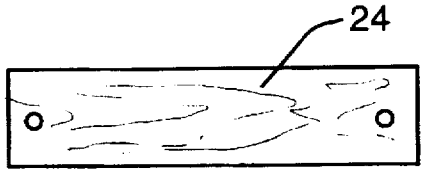
Figure 5D:
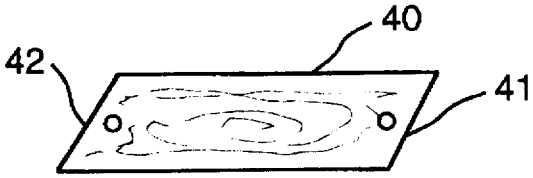
Figure 5E:
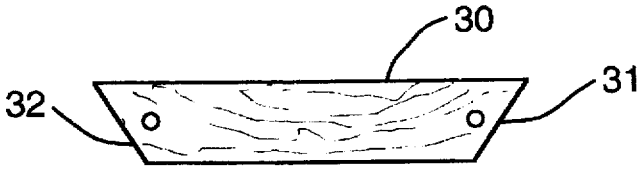
Figure 5F:
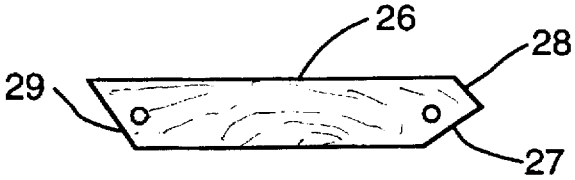

Four equally arcuately spaced generally identically constructed support units 20 are arranged for supporting table 12 on a generally horizontal surface such as floor or the ground. Description of one support unit 20 will follow, with it to be understood that it pertains to each of the units 20. All of the interconnected elements comprising the support unit 20 are detachably secured as by carriage bolts, washers, and nuts. The specific connections of the elements will not be described with it being understood that the connections are by removable means, as indicated. Support unit 20 includes an elongated lower transverse seat base 22 having a generally rectangular shape with its ends being at 90 degrees to its longitudinal axis, the seat base 22 being suitably shaped to engage a generally horizontal surface. A pair of identically shaped and sized seat legs 24 extend vertically, upwardly from the inside of seat base 22, each seat leg 24 being fixed to an inner end section of the seat base 22. An upwardly extending secondary leg 26 is fixed at its lower end to an inner mid-section of the seat base 22. The secondary leg 26 extends upwardly at an acute angle to the seat base 22 and has its upper end secured to the underside of table 12 by being fixed to one of the table braces 16 or 18. As shown in FIG. 5*f*, the outer section 27 of the lower end of secondary leg 26 is at an angle of about 22.5 degrees to the longitudinal axis of the leg 26, with the inner section 28 of the lower end of the same secondary leg 26 being at an angle of 67.5 degrees to the longitudinal axis of the leg 26. The upper end 29 of the secondary leg 26 abuts the underside of table 12 and is at an angle of 67.5 degrees to the longitudinal axis of the leg 26. The inner section 28 of the lower end of secondary leg 26 is coplanar with the longitudinal lower edge of seat base 22 and with that same lower edge will engage a horizontal surface. The outer section 27 of the lower end of secondary leg 26 abuts the inner mid-section of seat base 22.

Each support unit 20 also includes a pair of elongated generally parallel identically shaped wing members 30 fixed at intermediate portions thereof to and surrounding an intermediate section of the secondary leg 26. The wing members 30 are arranged above and generally parallel to the seat base 22 and in planes at right angles to the vertical plane of the seat base 22. Each wing member 30 is somewhat rhomboidal in shape and as shown in FIG. 5*e* the ends being in planes directed to each other and at angles of 67.5 degrees to the longitudinal axis of the wing member 30. There is also included in each support unit 20, an upwardly extending elongated top brace member 40 fixed at the lower end 41 thereof to and in between the wing members 30. The upper end 42 of the top brace member 40 abuts the underside of table 12 and is fixed thereto by being secured to one of the table braces 16 and 18. The brace member 40 is generally parallel to secondary leg 26. The shape of the top brace 40 is that of a parallelogram with the ends 41 and 42 being generally parallel to each other and at angles of 67.5 degrees to the longitudinal axis of the top brace 40. To each upper section of the inner end of each wing member 30 is fixed an elongated angle brace 46 in abutment with an intermediate section of top brace 40 and in a plane generally parallel to the seat base 22. Each angle brace 46 is generally rhomboidal in shape, its ends 47 and 48 being in planes directed to each other and at angles of 45 degrees to the longitudinal axis of the angle brace 46 as shown in FIG. 5*b*. Among the four shown support units 20 there are four angle braces 46. Each angle brace 46 has one end 47 is fixed to one wing member 40 and its other end 48 fixed to an adjacent wing member 40 of an adjacent support unit 20. In their assembled arrangement the four angle braces 46 define a generally square pattern.

A seat assembly 50 is secured to each support unit 20. Each seat assembly 50 is generally V-shaped and would be arranged radially outwardly of the table 12 as shown. Each seat assembly 50 is formed of sections of wood, four shown, secured to under braces 51, 52, and 53. A seat assembly 50 is fixed onto the upper outer sections of the wing member 30 with underbrace 51 in abutment therewith with under braces 52 and 53 being fixed to the upper outer end sections of seat legs 24.

Figure 8:
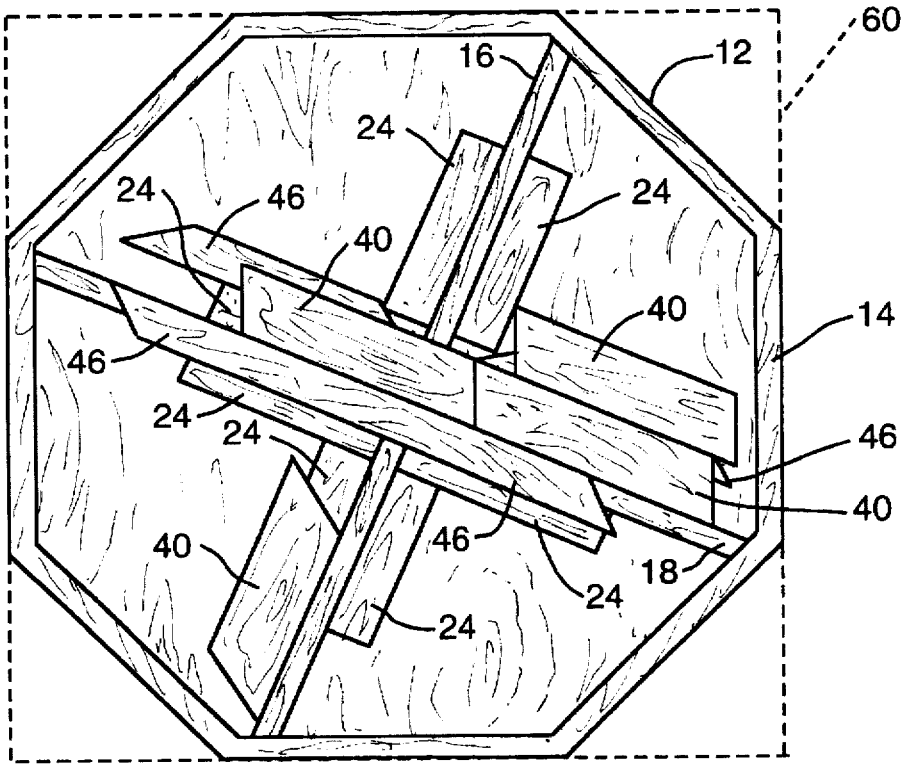
Figure 9:
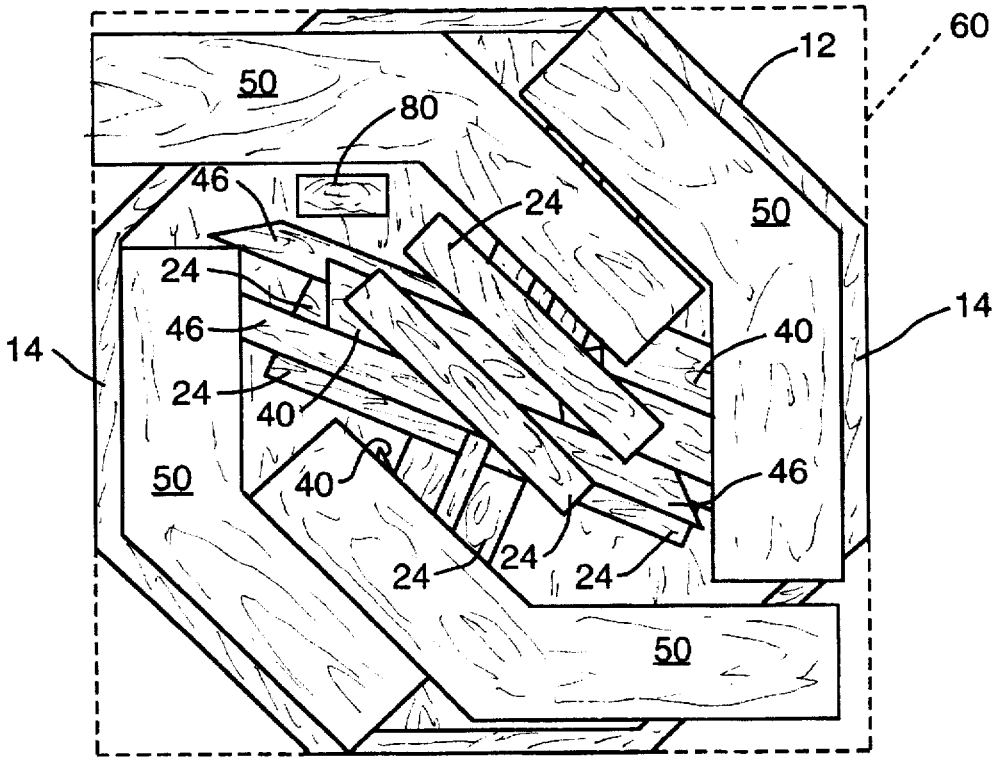
Figure 10:
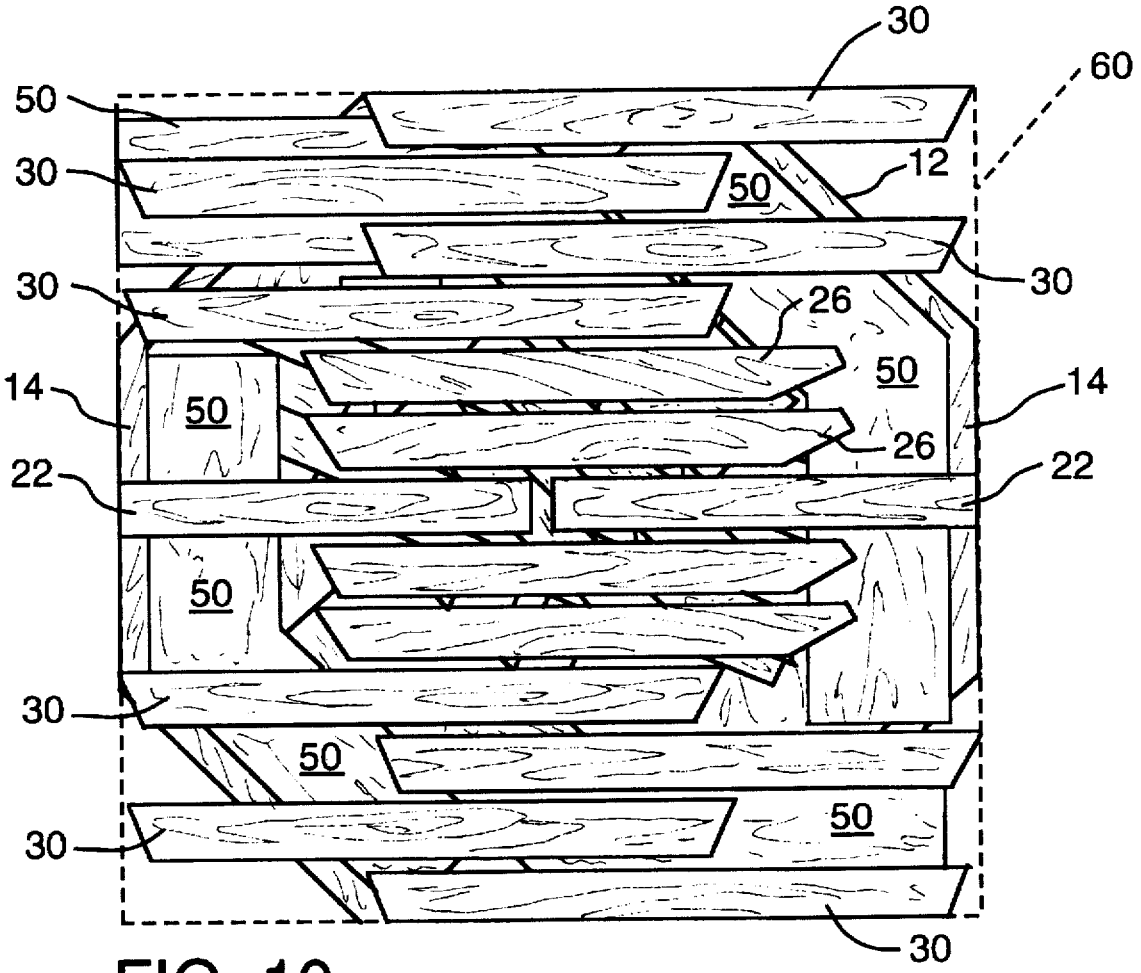

The picnic table assembly 10 may be packaged and shipped with the support units 20 disassembled from the table 12 and the elements forming the support units being likewise disassembled. FIGS. 6–10 show schematically a sequence of arranging the elements of the support units 10 and the seat assembly 50 on the underside of table 12 to form a layered sandwiched pattern for packaging and shipping. FIG. 6 shows table 12 lying on its upper surface on a pallet or the like 60 shown in phantom outline. The first layer of elements is shown on FIG. 7. Four seat legs 24 have their inner sides in abutment with the inner sections of underbrace 18 as shown. Two angle braces 46 are arranged on upper sides of two of the seat legs 24. The remaining leg braces 26 are arranged in abutment with underbrace 16 and with inner arranged leg braces 24 and angle braces 46, as shown. FIG. 8 shows the second layering of elements. Four top braces 40 are layered in the positions shown. Two remaining angle braces 46 are placed on two of the inner seat legs 24. The next sequence of layering is shown in FIG. 9. The four seat assemblies 50 are arranged as shown. The remaining seat legs 24 are placed as shown. A hardware kit 80 would be emplaced in the position shown. The last sequences of layering is shown in FIG. 10. The remaining elements of the support units 20 ar arranged as the top layer. The eight wing members 30 are layered in a parallel fashion as shown. The two remaining seat bases 22 are arranged end-to-end and parallel to the wing member 30, as shown. The four secondary legs 26 are arranged, two each between the seat bases 22 and wing members 30, as shown. The complete arrangement of the elements as shown is FIG. 10 would then be wrapped in a heavy weight plastic wrap. Several of the packaged parts comprising the picnic table assembly 10 could be stacked one on top of another, all on a pallet 60, and banded. The entire group would then be ready to be transported by a fork lift truck into and out of a shipping compartment.

The combination of the elements of the picnic tables assembly 10 of this invention and their interconnected relationship provide a table that is sturdy as well as attractive. The unassembled elements are able to be arranged in a compact layered unit for packaging and shipping.

It should be dear to those skilled in this art that the shape of the various elements of the invention as described may be varied in shape and size. For example the table 12 may be rectangular, square or circular. The seat assembly 50 could be shaped to conform with a different table shape.

While I have shown and described a present preferred embodiment of this invention it is to be distinctly understood that the invention is not limited thereto, but may be otherwise embodied within the scope of the following claims.

I claim:

1. A picnic table assembly comprising a generally flat table member having upper and lower sections;

at lease three generally identically formed, arcuately spaced support means selectively detachably secured to the lower section of said table member for supporting said table member on a generally horizontal surface;

each of said support means having selectively detachable elements including:

a. a lower transverse seat base member having outside and inside surfaces shaped for engaging a generally horizontal surface;

b. a pair of identically shaped upwardly extending seat leg members one each secured at its lower end portion to an end portion of said seat base member;

c. an upwardly extended secondary leg member fixed at its lower end to the inside surface of an intermediate section of said seat base member to extend at an acute angle to said seat base member and having its upper end fixed to a portion of the lower section of said table member;

d. a pair of elongated parallel wing members having inner and outer sections arranged above and fixed above the midpoint of said seat base member, said wing members surrounding and fixed to an intermediate section of said secondary leg member;

e. an upwardly extending elongated top brace member fixed to and between the inner section of said wing members and having its upper end fixed to a portion of the lower section of said table member;

f. a generally flat seat assembly fixed to the outer section of said wing members; and said table member and the elements of said support means being shaped and sized such that when disassembled said elements may be arranged in a crossed pattern on the lower section of said table member to define a generally flat layered sandwiched pattern for packaging and shipping.

2. A picnic table assembly as set forth in claim 1 wherein each of said support means includes an elongated angle brace member having outer ends, each of said angle brace members fixed at one outer end to an inner section of one of said wing members and its other outer end fixed to the inner end section of an adjacent said wing member.

3. A picnic table assembly as set forth in claim 1 including four generally identically formed, arcuately spaced said support means.

4. A picnic table assembly as set forth in claim 2 including four generally identically formed, arcuately spaced said support means, and wherein said outer ends of each of said angle brace members of each support means is in engagement with a side portion of said top brace member, wherein said angle brace members in their fixed relationship define a generally square outline.

5. A picnic table assembly as set forth in claim 4 wherein both ends of said seat base member are generally 90 degrees to its longitudinal axis, both ends of said seat leg members are at generally 90 degrees to its longitudinal axis, said upper end of said secondary leg member is generally 67.5 degrees to its longitudinal axis and its inner lower end section is at generally 67.5 degrees to its longitudinal axis and its outer lower end is at generally 22.5 degrees to its longitudinal axis, the respective ends of said wing members are directed towards each other at generally 67.5 degrees to its longitudinal axis, the respective ends of said wing member are directed toward each other at generally 67.5 degrees to its longitudinal axis, the respective ends of said angle brace member are directed toward each other at generally 45 degrees to its longitudinal axis.

6. A picnic table assembly as set forth in claim 1 wherein said seat leg members are generally parallel and extend upwardly at generally right angles to said seat base member.

7. A picnic table assembly as set forth in claim 1 wherein said wing members are generally parallel to said seat base members.

8. A picnic table assembly as set forth in claim 1 wherein said top brace member is generally parallel to said secondary leg member.

9. A picnic table assembly as set forth in claim 1 wherein said seat assembly is generally V-shaped.

10. A picnic table assembly as set forth in claim 1 wherein said seat assembly is also fixed to the upper end of said leg members.

* * * * *